US007536892B2

(12) United States Patent
Amino et al.

(10) Patent No.: US 7,536,892 B2
(45) Date of Patent: May 26, 2009

(54) METHOD AND APPARATUS FOR FORMING SHEET METAL

(75) Inventors: Hiroyuki Amino, Fujinomiya (JP); Shigeo Matsubara, Machida (JP); Yan Lu, Fujinomiya (JP)

(73) Assignee: Amino Corporation, Shizuoka (JP)

( * ) Notice: Subject to any disclaimer, the term of this patent is extended or adjusted under 35 U.S.C. 154(b) by 201 days.

(21) Appl. No.: 11/446,997

(22) Filed: Jun. 5, 2006

(65) Prior Publication Data

US 2006/0272378 A1 Dec. 7, 2006

(30) Foreign Application Priority Data

Jun. 7, 2005 (JP) ..... 2005-167542

(51) Int. Cl.
*B21D 11/02* (2006.01)
*B21D 7/00* (2006.01)

(52) U.S. Cl. ..... 72/305; 72/311; 72/350; 72/418; 72/421; 72/115

(58) Field of Classification Search ..... 72/296, 72/297, 305, 311, 350, 349, 124–126, 112, 72/115, 83, 85, 418–421
See application file for complete search history.

(56) References Cited

U.S. PATENT DOCUMENTS

| | | | | |
|---|---|---|---|---|
| 3,564,895 | A * | 2/1971 | Pfanner | 72/351 |
| 4,185,488 | A * | 1/1980 | Miller et al. | 72/350 |
| 5,035,133 | A * | 7/1991 | White et al. | 72/350 |
| 6,216,508 | B1 | 4/2001 | Matsubara et al. | 72/43 |
| 6,505,492 | B2 * | 1/2003 | Jroski | 72/348 |
| 7,237,423 | B1 * | 7/2007 | Nagel et al. | 72/350 |
| 2004/0148997 | A1 | 8/2004 | Amino et al. | 72/297 |

FOREIGN PATENT DOCUMENTS

| | | |
|---|---|---|
| DE | 197 20 666 | 1/1998 |
| JP | 2003-53436 | 2/2003 |
| JP | 2003-236618 | 8/2003 |
| JP | 2005-28422 | 2/2005 |

OTHER PUBLICATIONS

The European Communication dated Mar. 14, 2007.
European Communication dated Jan. 17, 2008.
European Communication dated Feb, 29, 2008.

* cited by examiner

*Primary Examiner*—Dana Ross
*Assistant Examiner*—Debra M Sullivan
(74) *Attorney, Agent, or Firm*—Nields, Lemack & Frame, LLC

(57) ABSTRACT

In order to provide a method and apparatus for forming a sheet metal, in which a three-dimensional product such as a prototype for commercialized press-forming can be formed in short time without limitations as to the shape and with high accuracy, preventing body wrinkles or reduction of the sheet thickness, a process of: performing drawing-forming to a predetermine height by pushing the forming punch having a desired shape in the sheet thickness direction with the edges of the blank workpiece being clamped; performing shape-forming with the shaping tool in the opposite side to the forming punch by increasing a clamping pressure to lock movement of a material with the forming punch being pushed; performing drawing-forming again by decreasing the clamping pressure and raising the forming punch by a desired height; and performing shape-forming with the shaping tool by increasing the clamping pressure to lock movement of a material, is repeated at least once.

5 Claims, 7 Drawing Sheets

Fig.1 (conventional technology)
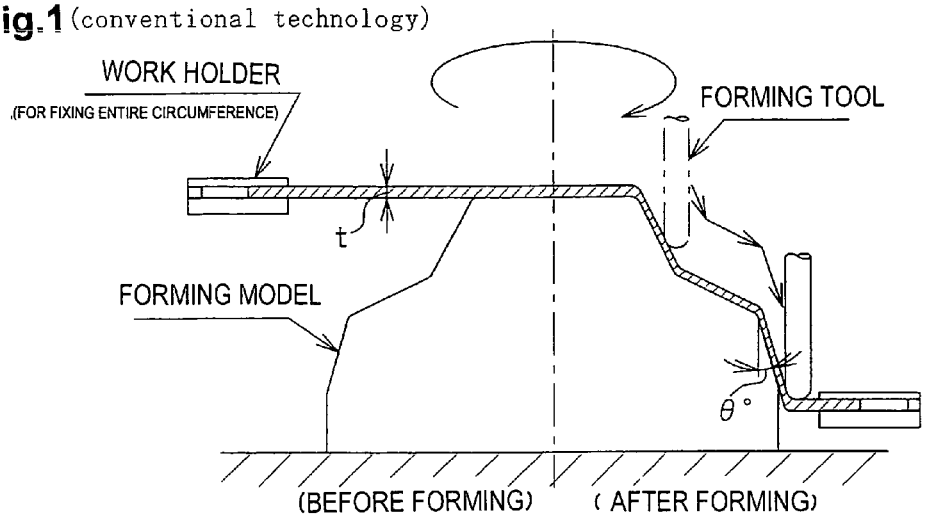
Fig.2 (conventional technology)
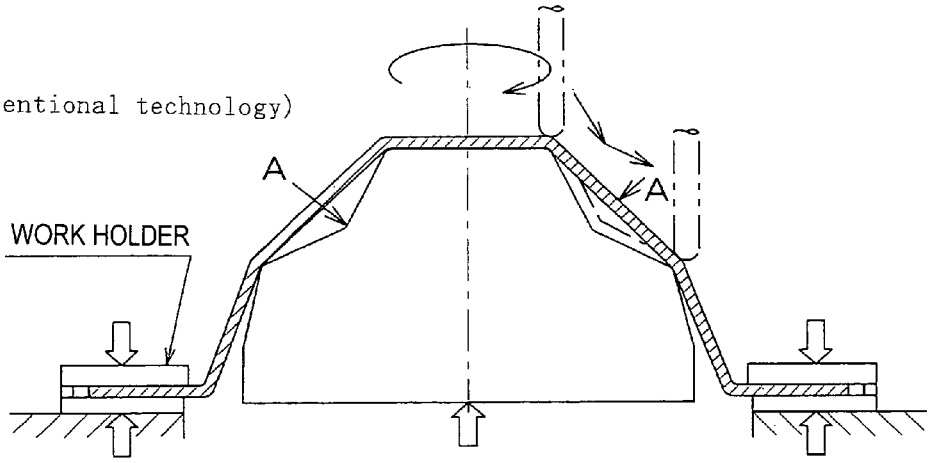
Fig.3
(conventional technology)
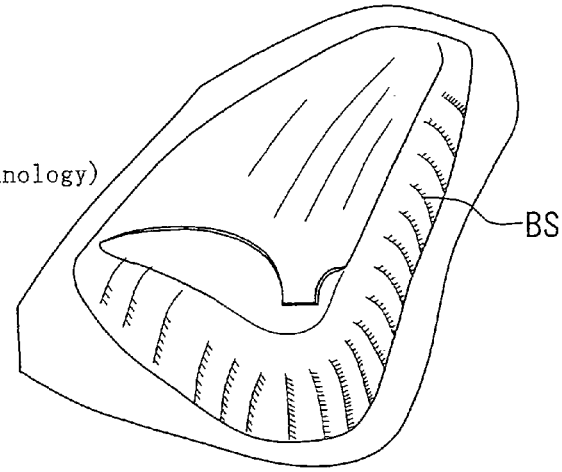

Fig.6-A
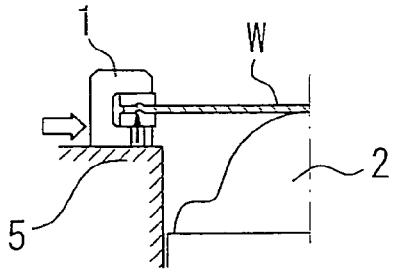
Fig.6-B
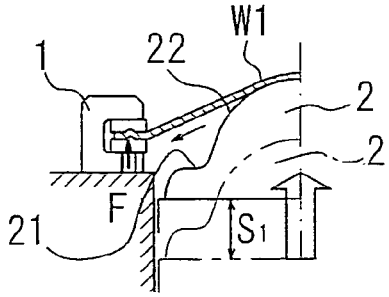
Fig.6-C
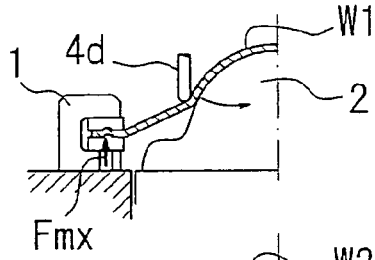
Fig.6-D
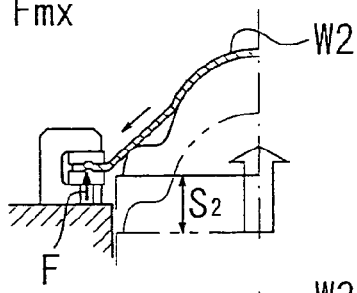
Fig.6-E
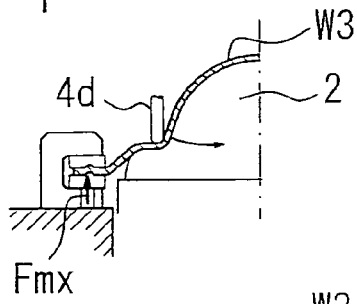
Fig.6-F
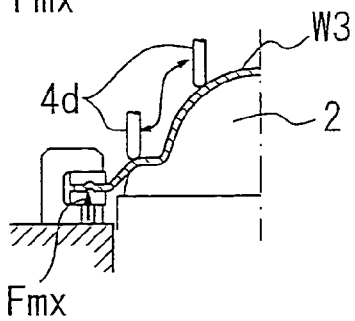

Fig.9-A
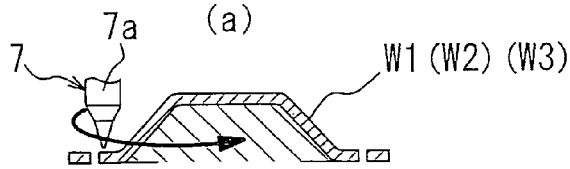
Fig.9-B
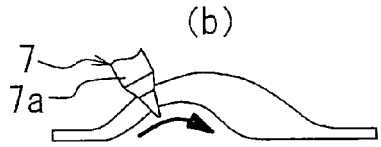
Fig.9-C
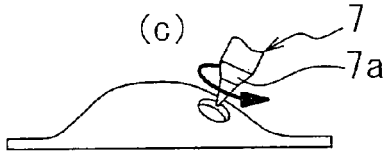
Fig.12
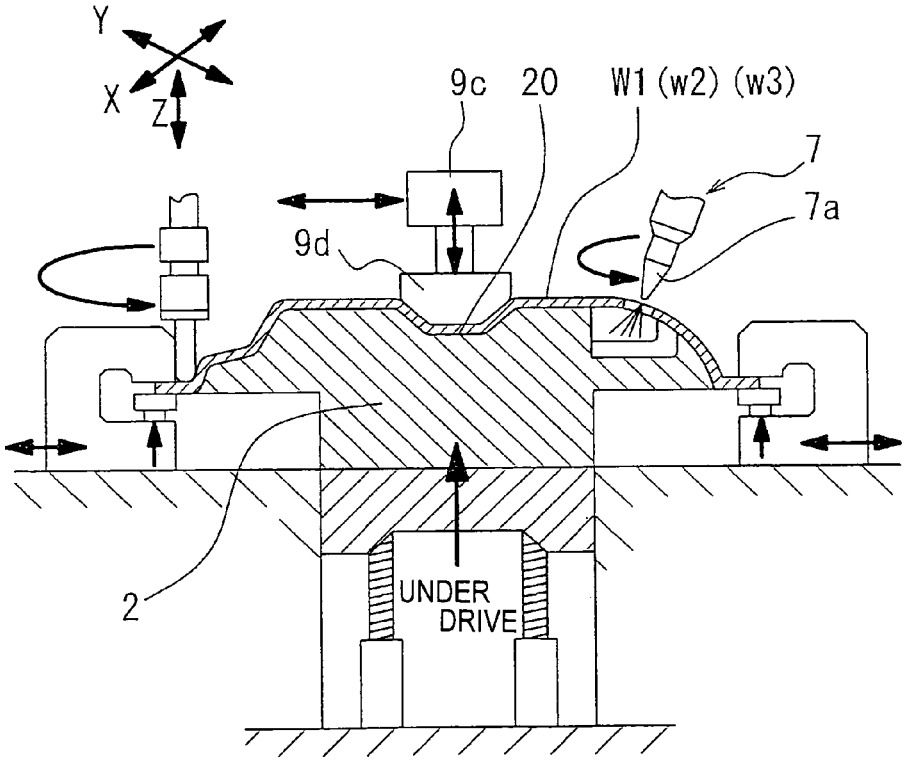

METHOD AND APPARATUS FOR FORMING SHEET METAL

FIELD OF THE INVENTION

The present invention relates to a method and apparatus for forming a sheet metal.

BACKGROUND ART

As a method or means for processing a sheet metal in a 3-dimensional shape, there has been known a forming method in which a metal sheet is fixed on an X-Y table and pressed down by a tool disposed in an upper position and movable in a Z-axis direction. In this case, the tool is moved to sequentially generate plastic deformation in the metal sheet. In an application of this method, a forming model may be adopted. FIG. 1 shows an outline of this forming method.

However, the conventional technique has the following shortcomings because the entire shape to be formed is sequentially formed by drawing a contour line with a bar-like tool.

1) The forming requires much time until the end of the work.

Therefore, it is difficult to provide a sufficient amount of commercialized products, such as 500 pieces per a month.

2) A sheet thickness is significantly reduced.

Assuming that the thickness of a blank sheet is $t_0$, the sheet thickness after the forming is t, the forming angle is θ, and the thickness reduction ratio is δ, a sheet thickness after the forming can be obtained by $t=t_0 \cdot \sin\theta$. Conventionally, if the forming angle is 20° and the sheet thickness is 0.8 mm, the thickness reduction ratio becomes 34.2%, so that a portion having the reduced thickness may be susceptible to breakdown. For example, if the sheet metal is used in a car component, the thickness reduction ratio should be within 30%. However, this requirement cannot be observed by using the conventional forming technique.

3) It is difficult or impossible to form a vertical wall.

If there is an abrupt angle change in the formed product, it is difficult to perform forming to model this shape. The forming angle θ is limited to 15° in aluminum, 20° in SPC, and 25° in SUS. Therefore, in addition to 2), there is a limitation to the shape that can be formed.

4) The surface finishing is not good.

Since the forming is performed by moving the bar-like tool along a contour line, a moire shape tool trace is inevitably generated. If a pitch is made minute to reduce this tool trace, the forming process takes longer time.

5) Accuracy is insufficient.

The conventional art is a method of using only "extension" of a material. Therefore, the finished product may be poor in sheet thickness reduction or numerical accuracy in comparison with a press-formed product.

In order to solve such problems, the inventors have proposed, in Japanese Patent Unexamined Application Publication No. 2003-53436, a method in which rough forming is performed by pushing a forming punch having a desired shape in the thickness direction of a blank workpiece with its edge being clamped, and then shape-forming is performed with a bar-like tool from the opposite direction while the blank workpiece are held between the forming punch and the bar-like tool, with the forming punch being pushed in.

According to this method, the aforementioned problem has been considerably alleviated. However, even in this method, as shown in FIG. 2, the entire workpiece is roughly formed in one time by pushing the forming punch having a shape to be formed in the sheet thickness direction with the entire stroke, and then, detailed forming is performed in this state. Therefore, if there is a recess A in the shape to be formed as shown in FIG. 2, body wrinkles BS are inevitably generated due to a redundant material as shown in FIG. 3. As a result, product accuracy may be degraded.

DISCLOSURE OF THE INVENTION

The present invention is contrived to solve the aforementioned problems, and an object of the present invention is to provide a forming method capable of forming a three-dimensional product such as a prototype for commercialized press-forming in short time and with high accuracy, without limitations as to the shape or generating body wrinkles caused by a redundant material.

In addition, another object of the invention is to provide an apparatus suitable for embodying the aforementioned forming method.

In order to achieve the aforementioned objects, there is provided a method of forming a sheet metal by pushing a forming punch having a desired shape to be formed in a sheet thickness direction of the blank workpiece with edges of the blank workpiece being clamped, and pershape to be formed-forming using a shaping tool disposed in the opposite side of the blank workpiece to the forming punch with the forming punch being pushed, wherein a process of: performing drawing-forming to a predetermine height by pushing the forming punch having a desired shape in the sheet thickness direction with the edges of the blank workpiece being clamped; performing shape-forming with the shaping tool in the opposite side to the forming punch by increasing a clamping pressure to lock movement of a material with the forming punch being pushed; performing drawing-forming again by decreasing the clamping pressure and raising the forming punch by a desired height; and performing shape-forming with the shaping tool by increasing the clamping pressure to lock movement of a material, is repeated at least once.

According to the method of forming a sheet metal according to the present invention, the drawing-forming by the forming punch and the incremental forming by the shaping tool are combined. Therefore, it is possible to minimize reduction of the sheet thickness and form a vertical wall having a forming angel of 15° to 25°. In addition, it is possible to provide sufficient hardness even for a tool trace and reduce time for forming.

Furthermore, the drawing-forming and the incremental forming are combined to sequentially perform forming in a stepping manner such that the forming punch is maintained in a position to once lock movement of a material after the drawing-forming is performed by raising the forming punch to a predetermined height, the incremental forming is performed in this state, the clamp pressure is reduced, the drawing-forming is performed again to a desired height by raising the forming punch, and the incremental forming is performed by once locking movement of a material in this state. As a result, it is possible to prevent body wrinkles caused by a redundant material. Therefore, it is possible to perform forming with high accuracy even in any complicated shapes.

According to another aspect of the present invention, there is provided an apparatus for forming a sheet metal, comprising: a plurality of clamp fixtures disposed with a predetermined interval on a bed in order to clamp edges of a blank workpiece in a sheet thickness direction, and capable of moving in forward and backward directions and stopping with a variable clamping pressure; a forming punch disposed in an inner portion from the clamp fixtures and having a desired shape; a computerized numerical controlled (CNC) forming punch elevator for pushing the forming punch into the blank workpiece clamped by the clamp fixtures and freely stopping at a setup position, for drawing-forming; a CNC incremental forming device equipped in a structural frame so as to move in three axis directions and performing forming in combination with the forming punch for the blank workpiece for which the drawing-forming has been performed in a stepping manner by sequentially pushing the forming punch.

According to the apparatus of forming a sheet metal of the present invention, it is possible to implement all of the effects of the method of forming a sheet metal according to the present invention.

The method of forming a metal sheet according to the present invention may include a trimming process or a piercing process performed for a formed product or a blank workpiece in the middle of the forming.

The apparatus for forming a metal sheet according to the present invention may further include a CNC laser cutting device for performing a removal process such as trimming or piercing for the blank workpiece or product formed by the forming punch or the CNC incremental forming device.

According to the present invention, the forming is performed in one place until a final product or a product having a shape near the final is obtained. Therefore, it is possible to improve efficiency.

In addition, the apparatus for forming a sheet metal according to the present invention further comprises a CNC top forming device having a compressive forming tool for compressively forming a top portion of the blank workpiece formed by the forming punch.

Therefore, it is possible to manufacture a product having a recessive top portion with high accuracy.

Other feature or advantages of the present invention will be apparent from the following detailed descriptions or with reference to the accompanying drawings. However, the present invention is not limited to the shown embodiments if the characteristics of the present invention can be achieved. Also, it would be apparent to those skilled in the art that various modifications and changes can be made without departing from the concept or scope of the present invention.

BRIEF DESCRIPTIONS OF THE DRAWINGS

FIG. 1 is a side cross-sectional view illustrating a sheet metal forming method of a conventional art;

FIG. 2 is a side cross-sectional view illustrating a sheet metal forming method of a conventional art;

FIG. 3 is a perspective view illustrating a formed product having an error generated by using the method of FIG. 2;

Figure 7:
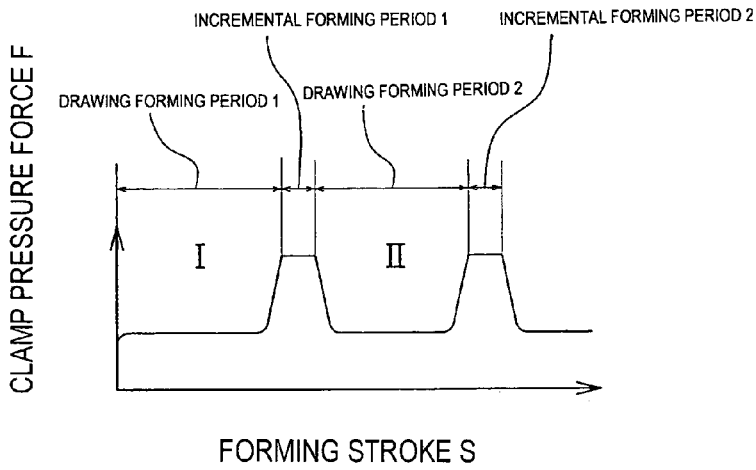
Figure 8:
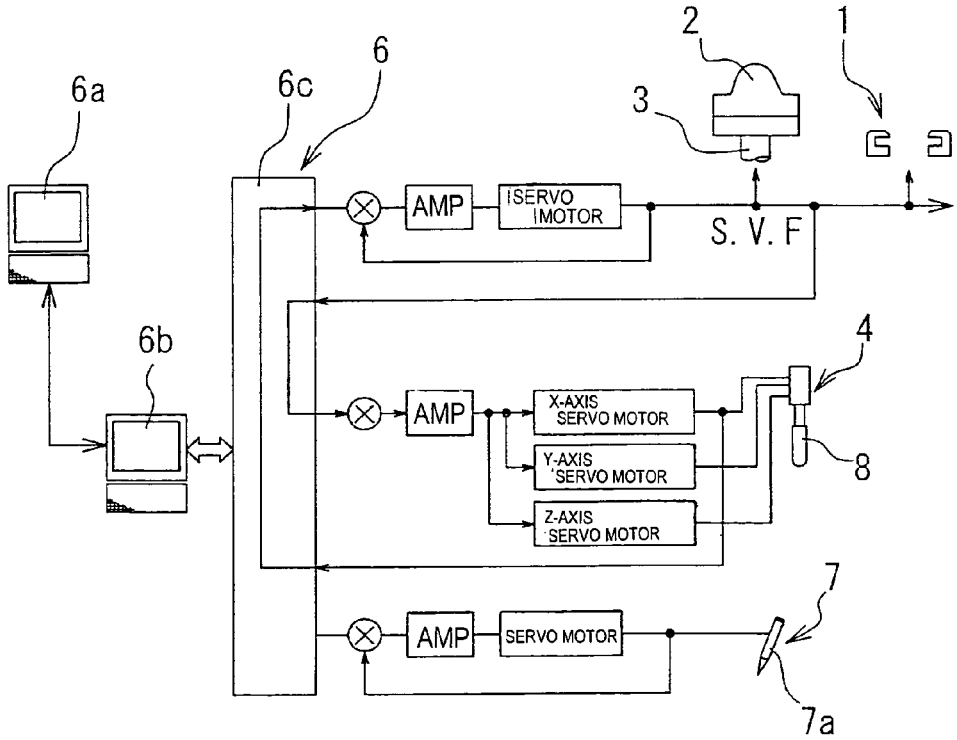
Figure 10:
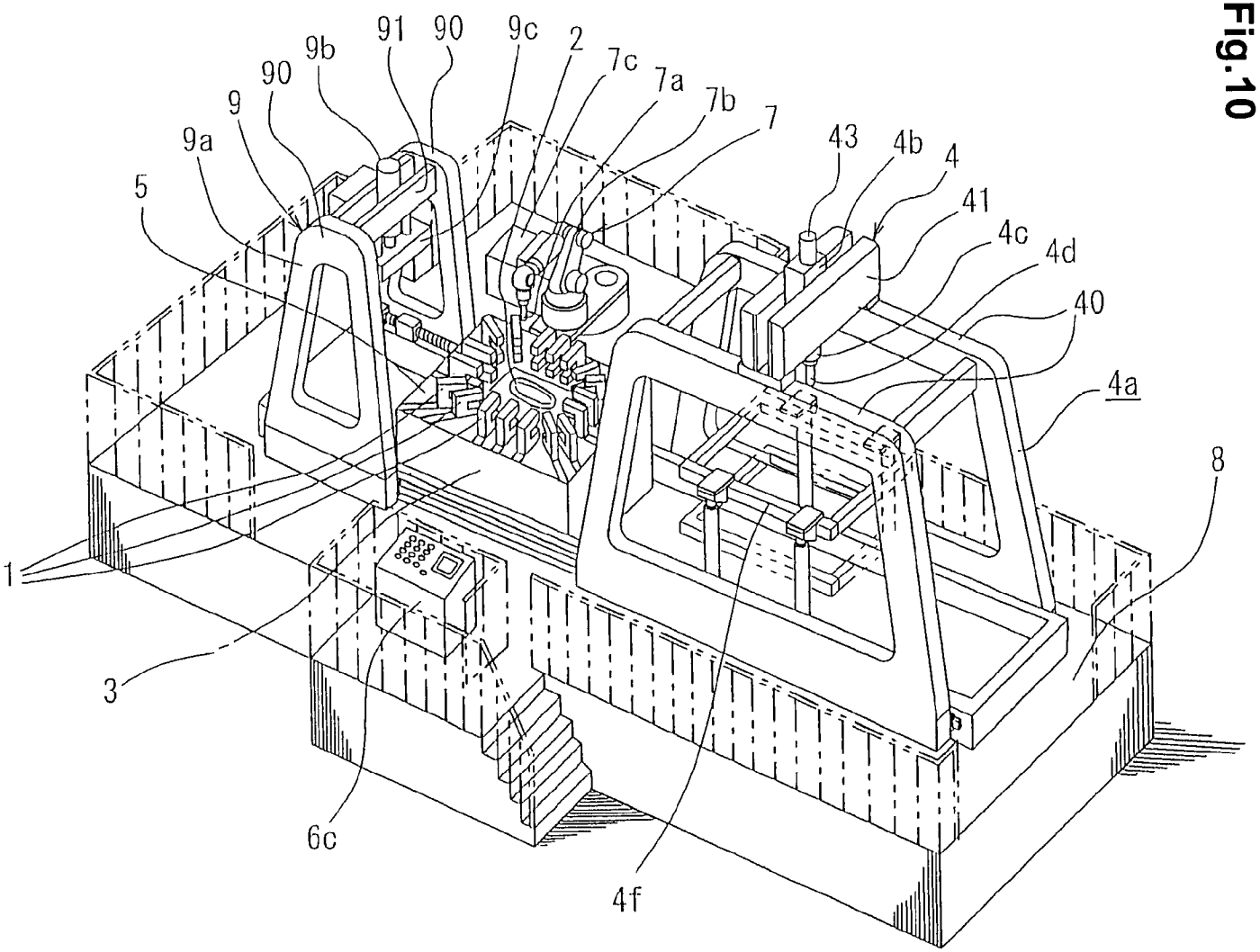
Figure 11:
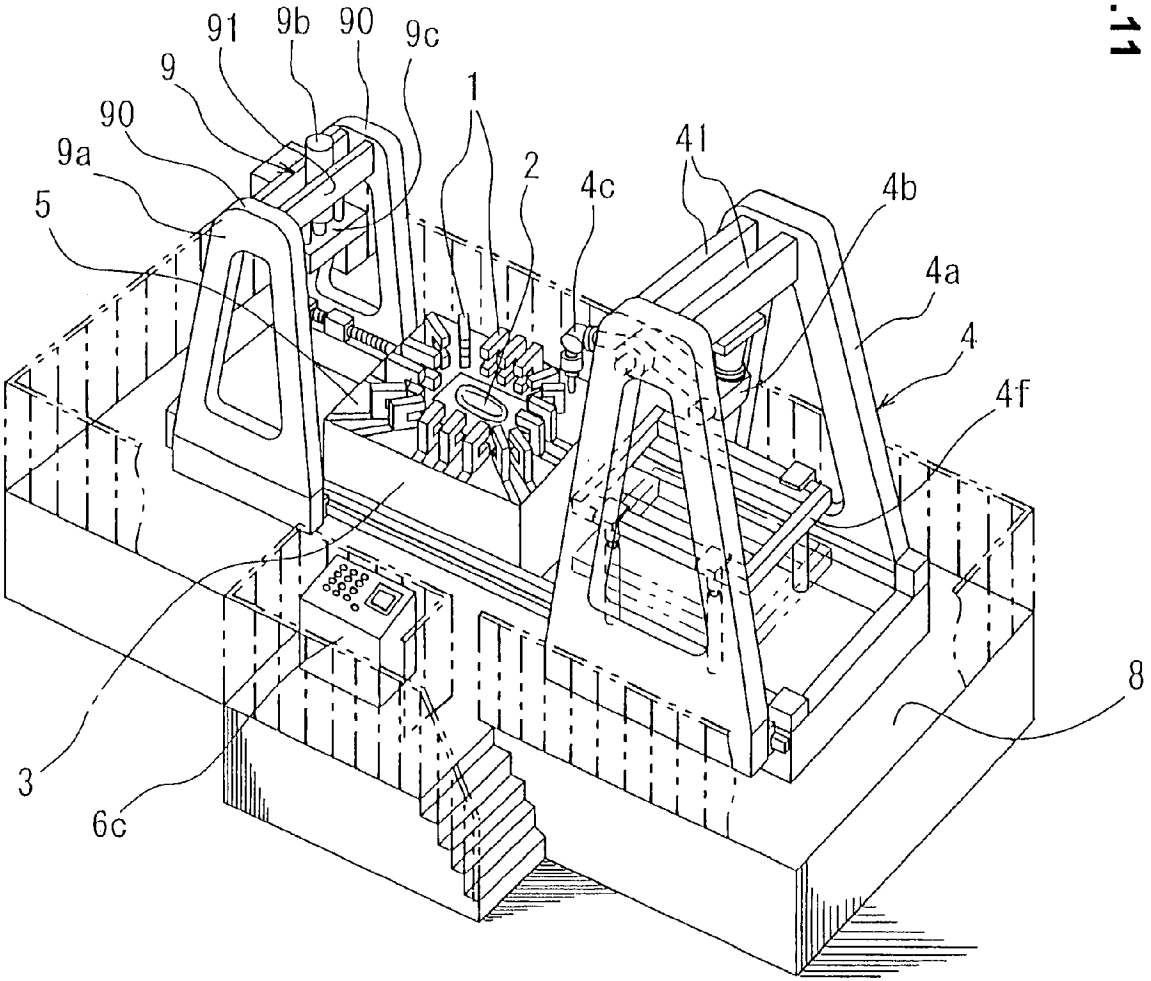

FIGS. 6-A to 6-F are diagrams for describing a forming method according to the present invention in sequence;

FIG. 7 is a graph showing a relationship between a forming stroke and a clamp pressure according to the present invention;

FIG. 8 is a diagram for describing a control system according to the present invention;

FIGS. 9-A to 9-C are diagrams for describing a laser cutting example according to the present invention;

FIG. 10 is a perspective view illustrating an example of a sheet metal forming apparatus according to the present invention;

FIG. 11 is a perspective view illustrating another example of a sheet metal forming apparatus according to the present invention; and FIG. 12 is a cross-sectional view schematically illustrating a forming state according to the present invention.

DETAILED DESCRIPTION OF THE INVENTION

Hereinafter, embodiments of the present invention will be described with reference to the accompanying drawings. FIGS. 4 to 7 show an example of a method and apparatus for forming a sheet metal according to the present invention.

Figure 4:
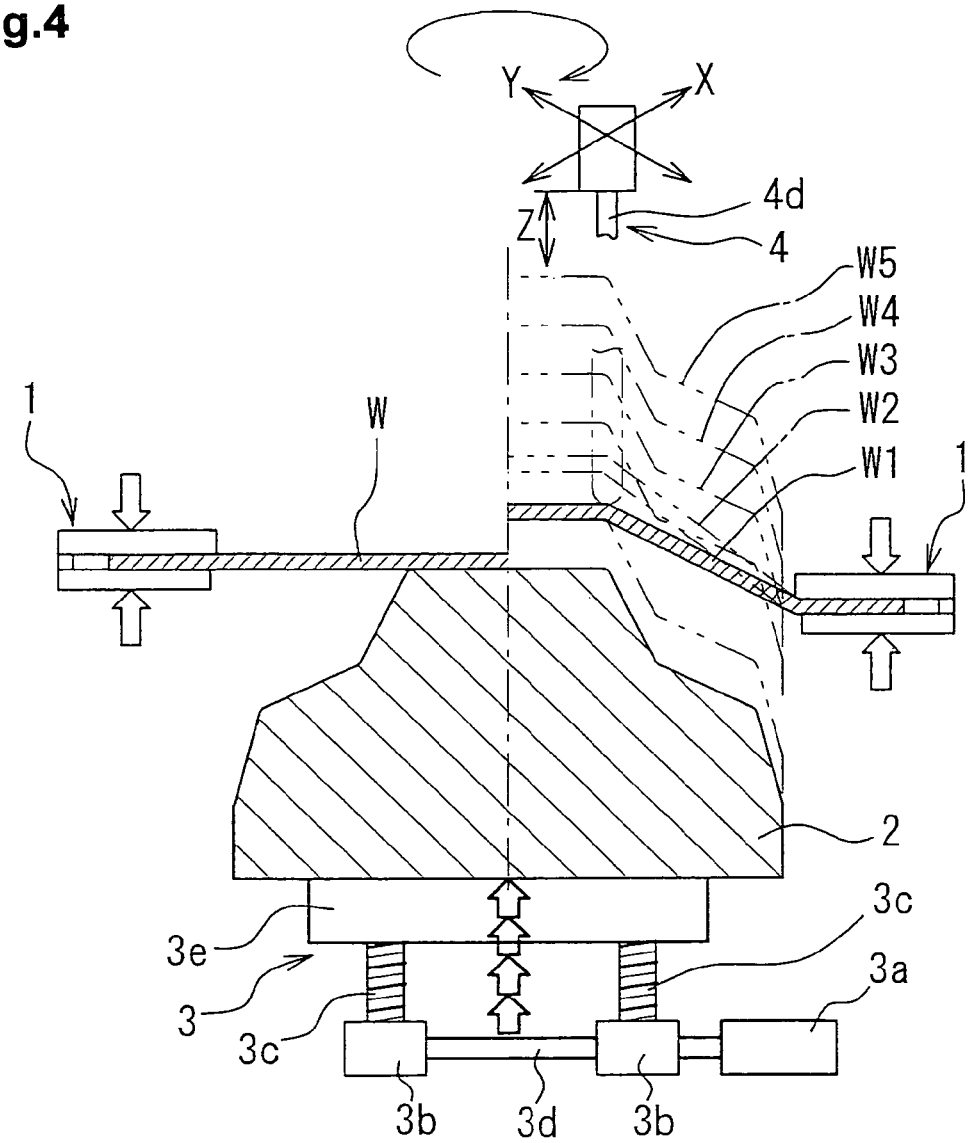
FIG. 4 is a side view schematically illustrating a forming method according to the present invention before and after the forming in each half.

In FIG. 4, the reference numeral 1 denotes a plurality of clamp fixtures arranged in a required interval on a bed 5 for clamping edges of a blank workpiece (a sheet type) W in a sheet thickness direction. The clamp fixture 1 has a variable clamp pressure and is capable of moving in a forward/backward direction or stopping in a desired position. The reference numeral 2 denotes a forming punch having a desired shape disposed in an inward direction from the clamp fixture. The reference numeral 3 denotes a computerized numerical controlled (CNC) forming punch elevator which stepwise raises the forming punch 2 to be pushed into the blank workpiece W and sequentially stops at setup positions for the drawing-forming.

The reference numeral 4 denotes a CNC incremental forming apparatus which performs forming in combination with the forming punch for the blank workpiece that has been drawn by sequentially raising or stopping the forming punch in a stepping manner and is capable of freely moving in three axis directions.

Figure 5:
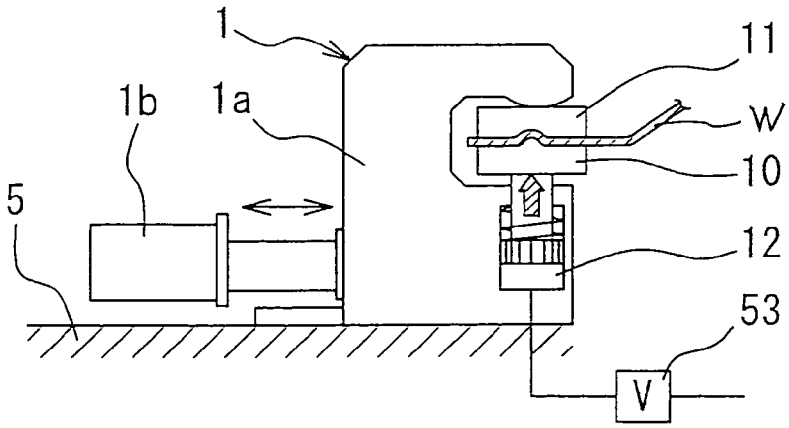
FIG. 5 is a side view illustrating a clamp fixture and a clamp condition according to the present invention.

As shown in FIG. 5, the clamp fixture 1 includes a dice 10 for mounting the edge of the metal sheet W, a press holder 11 facing the dice 10, a block-shaped body 1*a* having a pressing actuator 2 for applying pressure to the dice 10 or the press holder 11, and a shifting actuator 1*b* fixed on a bed disposed behind the body 1*a* and having an output portion connected to the body 1*a*.

The pressing actuator 12 and the shifting actuator 1*b* may be of an arbitrary type such as a mechanical type including a bolt and a set of a nut and a servo motor for translating the bolt, a hydraulic type, or the like. In the present embodiment, a hydraulic type is adopted, and the pressing actuator 12 is adapted to adjust the clamp pressure F to a predetermined value by using a control element 53 such as an electronic proportional valve.

In addition, each clamp fixture 1 is independently operable. Specifically, a predetermined number of pressing actuators 12 can be selectively operated depending on the thickness, material, mechanical property, a shape to be formed of the metal sheet, and the like. Otherwise, all or a desired number of pressing actuators 12 and the shifting actuator 1*b* may be combined to operate.

The forming punch 2 includes those of a gun type or a master type. Typically, the forming punch 2 is made of metal such as a zinc alloy, a low melting point alloy, or a resin-coated zinc alloy. Occasionally, the forming punch 2 may be made of a hard plastic, FRP, or the like. The shape of the forming punch 2 includes not only a linear or curved inclination plane, but odd-shaped parts such as a stepped portion, a concave plane, a convex plane, and the like. Also, the odd-shaped parts include a protrusion, a lug, a recess, a groove, or the like.

The CNC forming punch elevator 3 is digitally controlled by using a computer as control means, and is capable of allowing the forming punch to stop at an arbitrary position, to be maintained in that position, or to be controlled with a predetermined velocity.

The CNC forming punch elevator 3 is disposed on the bottom of the recessive room formed in an inward direction from the edge of a bed or frame (hereinafter, called as a bed). A hydraulic cylinder is not proper due to the difficulty in position control. A mechanical actuator of a serve system, for example, a combination of a servo motor 3*a*, a brake 3*b*, and a bolt 3*c* may be preferable. A plurality of brakes 3*b* and the bolts 3*c* may be connected by a synchronous axis 3*d*.

At a leading end of the bolt 3*c* as an output portion, a form attachment shelf 3*e* is connected, where the forming punch 2 having a three-dimensional shape corresponding to the product to be formed is removably attached.

Then, a forming process will be described. When forming is initiated, the forming punch 2 having a shape to be formed is fixed on the form attachment shelf 3*e* with bolts and nuts. Then, the blank workpiece W1 to be formed is carried on the bed 5 by a conveyer device such as a magnet chuck or a suction machine. In this case, the body 1*a* is backwardly moved by operating the shifting actuator 1*b* for the clamp fixture 1, the press holder 11 is moved to an opening direction by using each pressing actuator 12 for the clamp fixture 1, a metal sheet W is inserted, the body 1*a* is forwardly advanced to insert the edges of the metal sheet W between the press holder 11 and the dice 10, and the pressing actuator 12 is operated to clamp the edges of the blank workpiece W. As a result, as shown in FIG. 6-A, the blank workpiece W is clamped by the clamp fixture 1 across its entire circumference. The blank workpiece W may be selected from a steel sheet, an aluminum sheet, a stainless plate, a composite plate, and the like.

As described above, although the circumference of the blank workpiece W is clamped by the clamp fixture 1, the clamp pressure F is set to be small when the forming is initiated. In this state, the CNC forming punch elevator 3 is driven such that the forming punch 2 is raised by a desired height S1 based on a forming program. This state is shown in FIG. 6-B. The blank workpiece W is plastically deformed in a sheet thickness direction as the forming punch 2 is upwardly pushed from a lower position. Because the clamp pressure F is small, the blank workpiece W may be moved freely. Therefore, the drawing-forming can be performed for only a setup stroke. In this case, the force to the pressing actuator 12 is attenuated to promote a material flow and prevent shortage of a material. In this example, the drawing-forming is performed for a top portion or a ceiling portion.

The forming punch 2 continues to stop at a desired height by the CNC control for the CNC forming punch elevator 3. In this state, the pressing actuator 12 of the clamp fixture 1 is operated to generate a large clamp pressure Fmx. As a result, the first stage drawing-forming blank workpiece W1 is locked so that a material cannot be freely moved.

In this state, the CNC incremental forming device 4 is operated to perform the shape-forming using the shaping tool 4*d*. This is shown in FIG. 6-C. The portion formed in the first step is accurately finished by drawing a contour line to follow their shapes in combination with the forming punch 2. When there is a step portion 21 in the shape to be formed, a vertical wall 22 is formed halfway to the step portion. In addition, the representative one of the shaping tools 4*d* is a bar-like tool having a curved surface on its leading end. This tool may have a ball-point pen shape in which a hard ball can be freely rolled.

Subsequently, the pressing actuator 12 of the clamp fixture 1 is operated again to reduce the clamp pressure F so as to allow a material to be freely moved. In this state, the CNC forming punch elevator 3 is driven to raise the forming punch 2 by a predetermined height S2. In this stroke position, the movement of the forming punch 2 is stopped and maintained in this state, and the drawing-forming is resumed. This is shown in FIG. 6-D. As a result, a second stage drawing-forming blank workpiece W2 is obtained.

Subsequently, in the state that the forming punch 2 is maintained in its position, the pressing actuator 12 of the clamp fixture 1 is driven to generate a large clamp pressure Fmx. As a result, the blank workpiece W2 is locked so that a material cannot be freely moved. Then, the CNC incremental forming device 4 is driven to perform shape-forming using the shaping tool 4*d*. This is shown in FIGS. 6-E and 6-F. The shaping tool 4*d* is driven to draw a contour line to follow these shapes in combination with the forming punch 2 or to 3-dimensionally move. As a result, the portion drawing-formed in the second step is accurately finished to provide a formed product W3 in this example.

As shown in FIG. 6-B, even when the shape to be formed has a vertical wall 22 having a large inclination and a step portion 21 extended thereto, it is possible to reduce a material redundancy phenomenon by the drawing-forming in the first and second steps, the incremental forming in each step, and the control of the clamp pressure in that position. Therefore, it is possible to prevent body wrinkles. FIG. 7 shows a relationship between the forming stroke and the clamp pressure in the first and second steps I and II.

Although the successive forming is performed in the first and second steps in the present embodiment, the present invention includes a case that the product is produced in three or more steps. In addition, FIG. 4 shows a 5 step forming example, in which a left half shows a state before the forming and a right half shows sequential forming steps.

FIG. 8 shows an example of a control system according to the forming method of the present invention. The reference numeral 6 denotes a control device. The control device 6 is operated such that IGES data are transmitted from a computer 6*a* storing the 3-dimensional plane data of the product to a manufacturing CAM 6*b*, and the data are transmitted again from the manufacturing CAM 6*b* to the CNC controller 6*c* made of a computer. The CNC controller 6*c* computes the number of steps (of drawing-forming+incremental forming) depending on the material of the blank workpiece, the sheet thickness, and the shape to be formed, positions (rising amount S, S1, . . . , Sn) and velocities V, V1, . . . , Vn, in each step, clamp pressures F and Fmx, and driving conditions (such as positions, moving velocities, and traces) of each X, Y, and Z axes for incremental forming in each step.

Based on these computation results, digital signals including predetermined positions, velocities, and the clamp pressures are transmitted from the CNC controller 6*c* to the clamp fixture 1 and the serve motor of the CNC forming punch elevator 3 to perform the first step of the drawing-forming. This forming condition is fed back to the CNC controller 6*c* and compared with a setup value, and then, a correction instruction is issued when there is difference. In addition, the position maintaining instruction is sent to the CNC forming punch elevator 3 so that the forming punch 2 is maintained in the first step position.

When the drawing-forming of the first step is completed, a clamp pressure increment signal indicating a predetermined level for locking the movement of the material is transmitted to the clamp fixture 1 based on that signal. In addition, the signals of positions and velocities are sent from the CNC controller 6*c* to the servo motors of each X, Y, and Z axis of the CNC incremental forming device 4 so that the incremental forming is performed by the shaping tool 4*d*. Similarly, during this forming, the forming condition is also fed back to the CNC controller 6*c* and compared with the setup value. Then, the correction instruction is issued when there is difference. Upon completion of the forming, a completion signal is sent to the CNC controller 6*c*. As a result, the drawing incremental forming is performed by at least two steps to provide the product. The shaping tool 4*d* may be commonly or differently used in each step.

According to the present invention, the time for forming is reduced in comparison with the method using only the incremental forming. In addition, the reduction of the sheet thickness is prevented by using both of the drawing-forming and the incremental forming. Therefore, it is possible to satisfy the sheet thickness reduction ratio within 30%. Furthermore, the tool trace is decreased by simultaneously using the drawing-forming, so that it is possible to perform the forming of the vertical wall having a large forming angle.

Still furthermore, the forming is not performed such that the entire workpiece is roughly formed by one-time drawing-forming and then, incremental forming is locally performed using a tool. Instead, the drawing-forming and the incremental forming are performed in two or more steps to complete the shape in a successive manner. In this case, the clamp pressure is controlled. Therefore, the redundant material is prevented, so that the body wrinkles or twisted wrinkles can be prevented. Therefore, it is possible to perform forming even for complicated shapes with high accuracy.

In addition, as shown in FIG. 9, a removal process such as trimming or piercing may be additionally performed for the formed product obtained after the steps or an unfinished workpiece by using a tool that can move in X, Y, and Z axes, for example, a 6-axis CNC laser cutting device 7. FIG. 9-A shows the state that the trimming is being performed, where the laser irradiating head 7*a* moves along a contour line or in a 3-dimensional shape. FIG. 9-B shows the state that the cutting is being performed, and FIG. 9-C shows the state that the piercing is being performed.

This removal process may be performed after both the drawing-forming in the first or second step and the incremental forming are completed, or during the period after the drawing-forming is completed in the first or second step and before the incremental forming is initiated. In either case, the cutting information such as movement traces or velocity conditions, and an output level is computed by the CNC controller 6*c* and transmitted to the servo motors of the CNC laser cutting device 7 for operation, as shown in FIG. 8.

When this process is added, this process and subsequent processes are performed in the same place until the final product shape is obtained. In other words, there is no need to convey the plastic forming workpiece to other areas to separately processing it. Therefore, it is possible to improve efficiency.

FIG. 10 shows a first example of an apparatus for forming a sheet metal to implement the method of forming a sheet metal according to the present invention.

The reference numeral 8 denotes a trapezoid frame. A bed 5 is fixedly arranged in the center of the trapezoid frame 8. A plurality of clamp fixtures 1 are arranged with a predetermined interval thereon. A recessive room is provided in an inward direction from the clamp fixtures 1, where the CNC forming punch elevator 3 is provided.

In one side of the longitudinal direction of the bed 5, a CNC incremental forming device 4 is disposed so as to be freely moved. In the other side, a top drive CNC top forming device 9 is disposed. In addition, in one side of the lateral direction of the bed 5, a CNC laser cutting device 7 is disposed. Also, in this example of the CNC incremental forming device 4, a work holder tool 4*f* capable of elevating with freedom is installed inside.

The aforementioned CNC incremental forming device 4 has an AC servo motor or a linear motor as a driving source. Also, the CNC incremental forming device 4 includes a structural frame 4*a* that can move along a trapezoid frame 8, and a principle shaft body 4*b* mounted thereon and having a tool holder 4*c* for removably attaching the shaping tool 4*d*.

The structural frame 4*a* includes a set of X-axis rails 40 longitudinally arranged in parallel on a top portion and a Y-axis rail 41 (a movable table) mounted between the X-axis rails 40. The Y-axis rail 41 is provided with a driving tool (not shown in the drawing) including a servo motor and a brake for moving the Y-axis rail 41 along a set of the X-axis rails 40.

The principle shaft body 4*d* is mount on the Y-axis rail 41 and includes a driving tool (not shown in the drawing) having a servo motor and a brake for moving along the Y-axis rail 41. The principle shaft body 4*b* has a tool holder 4*c* that can be downwardly extended, and a driving tool 43 (including a servo motor and a brake) for moving the tool holder 4*c* or a slide having the tool holder 4*c* along the Z-axis direction on top of it. Each of the servo motors are electrically connected to the CNC controller 6*c* provided in the center of the trapezoid frame 8, so that the position control of the tool holder 4*c* and the shaping tool 4*d* can be performed as desired based on the control signals from the CNC controller 6*c*.

The shaping tool 4*d* has an attachment to the tool holder 4*c* and a pressing portion for shaping the sheet metal W in detail or completing the entire shape in combination with the forming punch 2. The shaping tool 4*d* may be rotatable with respect to the tool holder 4*c*.

The CNC top forming device 9 includes a structural frame 9*a* provided with an AC servo motor or a linear motor as a driving source so as to move along the trapezoid frame 8, and a principle shaft body 9*b* mounted thereon. The principle shaft body 9*b* includes a tool holder 9*c* for detachably attaching the compressive forming tool 9*d*.

The structural frame 9*a* has a Y-axis rail 91 (a movable table) provided on top of it. The principle shaft body 9*b* is mounted on the Y-axis rail 91 and has a driving tool (not shown in the drawing) including a servo motor and a brake for moving along the Y-axis rail 91. The principle shaft body 9*b* includes a hydraulic cylinder, a holder screw, or a driving source such as a servo motor for moving the tool holder 9*c* along a Z-axis direction. This driving source, the driving source for movements of the structural frame, and the driving source for movement of the principle shaft body are electrically connected to the CNC controller 6*c*. The positions, velocities, and forces of the tool holder 9*c* and the compressive forming tool 9*d* can be adjusted as desired based on the control signals from the CNC controller 6*c*.

As shown in FIG. 12, the compressive forming tool 9*d* is to locally compress the sheet metal W in combination with a recessive portion 20 of the forming punch 2 and is made of an elastic material (a resilient material) such as a urethane rubber. When this forming method is simultaneously used, the top portion of the blank workpiece that does not make contact with or slightly makes contact with a part 20 of the forming punch is pressed by the tool 9*d* toward the part of the forming punch 20. As a result, the top portion of the blank workpiece is plastically deformed according to the part 20 of the forming punch.

The CNC laser cutting device 7 includes a 6-axis robot 7*b* driven by a servo motor and having a laser irradiation head 7*a* in its leading end and a laser oscillator 7*c* for supplying the laser irradiation head 7*a* with a laser light. The driving units of the servo motor and the oscillator are electrically connected to the CNC controller 6*c*, and the position and velocity of the laser irradiation head 7*a* and the laser beam intensity can be adjusted as desired based on the control signal from the CNC controller 6*c*. As shown in FIG. 12, the CNC laser cutting device 7 moves and performs a removal process while the laser beam is irradiated onto a desired position.

FIG. 12 schematically shows a state that the incremental forming, the local compressive forming, and the laser cutting are being performed.

FIG. 11 shows a method of forming a sheet metal according to the second embodiment of the present invention.

In this embodiment, the CNC incremental forming device 4 and the CNC laser cutting device 7 are combined with each other to perform the incremental forming and the laser cutting by replacing the tool. As a result, it is possible to provide a compact apparatus.

In other words, the CNC incremental forming apparatus 4 comprises an AC servo motor or a linear motor as a driving source, and the structural frame 4*a* movable along the trapezoid frame 8. However, the Y-axis rail 41 on its top portion is provided with a robot arm as a principle shaft body 4*b*. Also, the tool and the laser irradiation attachment are detachably attached to the holder 4*c* of the leading end of the arm.

Since other parts are similar to those shown in FIG. 10, like reference numerals denote like elements, and their descriptions are omitted.

The present invention is suitably applied to a prototype having a large-sized 3-dimensional shape. For example, car exterior panels such as a fender or a hood outer panel can be simply and accurately manufactured.

The invention claimed is:

1. A method of forming a sheet metal by pushing a forming punch having a desired shape to be formed in a sheet thickness direction of a blank workpiece with edges of the blank workpiece being clamped, and performing shape-forming using a shaping tool disposed in the side of the blank workpiece opposite to the forming punch with the forming punch being pushed, the method comprising clamping edges of said blank workpiece in a sheet thickness direction with a plurality of clamp fixtures disposed at predetermined intervals on a bed, said clamp fixtures capable of moving in forward and backward directions and stopping with a variable clamping pressure, wherein said forming punch is disposed inwardly of said clamp fixtures and has a desired shape, and wherein a CNC incremental forming device is equipped so as to move in three axis directions, and further comprising the steps of:

(a) performing drawing-forming to a predetermined height by pushing said forming punch having a desired shape in the sheet thickness direction with a CNC forming punch elevator with the edges of the blank workpiece being clamped; and then (b) performing shape-forming with said CNC incremental forming device in the side opposite to said forming punch by increasing the clamping pressure to lock movement of the workpiece with said forming punch being pushed;

(c) performing drawing-forming again by decreasing the clamping pressure and raising said forming punch again to a desired height; and then (d) again performing shape-forming with said shaping tool by increasing the clamping pressure to lock movement of the workpiece, and repeating steps (a) to (d) at least once.

2. The method according to claim 1, further comprising providing a control device including a computer storing the 3-dimensional plane data of the product to be manufactured, a manufacturing CAM, a CNC controller including a computer which computes the number of steps of drawing-forming and incremental forming depending on the material of said blank workpiece, the sheet thickness, and the shape to be formed, positions and velocities in each step, clamp pressures and driving conditions for incremental forming in each step, transmitting digital signals including predetermined positions, velocities, and the clamp pressures based on the computation results from said CNC controller to said clamp fixtures and a servo motor of said CNC forming punch elevator to perform the first step of the drawing-forming, feeding forming condition back to said CNC controller and comparing it with a setup value, and then, issuing a correction instruction when there is a difference, and sending the position maintaining instruction to said CNC forming punch elevator so that said forming punch is maintained in the first step position, and when the drawing-forming of the first step is completed, transmitting a clamp pressure increment signal indicating a predetermined level for locking the movement of the workpiece to said clamp fixtures based on that signal, sending the signals of positions and velocities from said CNC controller to said servo motors of each X, Y, and Z axis of said CNC incremental forming device so that the incremental forming is performed by the shaping tool, and during the forming, also feeding the forming condition back to said CNC controller and comparing it with the setup value, and then, issuing the correction instruction when there is difference, and upon completion of the forming, sending a completion signal to said CNC controller.

3. The method of forming a sheet metal according to claim 1, wherein a bar-like shaping tool and a compressive forming tool are selectively used as the shaping tool.

4. The method of forming a sheet metal according to claim 1, further comprising a trimming or piercing the formed product.

5. The method of forming a sheet metal according to claim 1, further comprising trimming or piercing said blank workpiece after the drawing-forming is completed in the first or second drawing-forming step.

* * * * *